US010877400B1

(12) United States Patent
Kuramoto et al.

(10) Patent No.: US 10,877,400 B1
(45) Date of Patent: Dec. 29, 2020

(54) DEVELOPING DEVICE AND IMAGE FORMING APPARATUS

(71) Applicant: FUJI XEROX Co., Ltd., Tokyo (JP)

(72) Inventors: Shinichi Kuramoto, Kanagawa (JP); Yoshifumi Ozaki, Kanagawa (JP); Yoshitaka Nakajima, Kanagawa (JP); Norihiro Tamazawa, Kanagawa (JP); Tomoyuki Yoshii, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/836,182

(22) Filed: Mar. 31, 2020

(30) Foreign Application Priority Data

Jul. 26, 2019 (JP) ..... 2019-138323

(51) Int. Cl.
*G03G 21/20* (2006.01)
*G03G 15/08* (2006.01)

(52) U.S. Cl.
CPC ..... *G03G 15/0889* (2013.01); *G03G 15/0896* (2013.01)

(58) Field of Classification Search
CPC ..... G03G 15/0889; G03G 15/0896; G03G 21/0052; G03G 21/206; G03G 2221/1678
USPC ..... 399/91, 92, 98, 107, 110, 111, 119, 120, 399/252, 258
See application file for complete search history.

(56) References Cited

U.S. PATENT DOCUMENTS 7,937,014 B2 * 5/2011 Kawamata ..... G03G 21/206 399/92
8,521,052 B2 * 8/2013 Kwak ..... G03G 15/0291 399/92
8,554,102 B2 * 10/2013 Ishikawa ..... G03G 15/0806 399/92
9,244,376 B2 1/2016 Kuramoto et al.

FOREIGN PATENT DOCUMENTS

JP 2005-346035 A 12/2005
JP 2008-39965 A 2/2008
JP 6127884 B2 5/2017

* cited by examiner

*Primary Examiner* — Hoan H Tran
(74) *Attorney, Agent, or Firm* — Sughrue Mion, PLLC

(57) ABSTRACT

A developing device includes a development roller, a housing, a suction device, and a discharging device. The development roller rotates to pass a developer to an image carrier. The housing includes an opening, which allows the development roller to face the image carrier therethrough, and a flow-in path, which is a gap formed to allow air to flow therethrough between the development roller and an edge of the opening downstream in a rotation direction of the development roller. The suction device has a suction path having a distal end serving as a suction port that is open to an outside of the housing, and sucks air through the suction port. The discharging device includes a through-hole, which extends through the housing to connect an inside to an outside of the housing, and a discharge path, which extends from the through-hole to the suction port. The discharge path merges with the suction path.

20 Claims, 4 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2019-138323 filed Jul. 26, 2019.

BACKGROUND

(i) Technical Field

The present disclosure relates to a developing device and an image forming apparatus.

(ii) Related Art

Japanese Unexamined Patent Application Publication No. 2005-346035 describes a developing device that accommodates a developer for developing a latent image formed on an image carrier. The developing device includes a developer carrier, which carries the developer and opposes the image carrier, a casing, which covers part of the developer carrier, and an opening continuous with the outside of the device. The developing device forms a gas flow path through which gas flows into the device between the casing and the developer carrier that has passed a portion opposing the image carrier, and through which the gas is discharged to the outside of the device from the opening.

Japanese Unexamined Patent Application Publication No. 2008-039965 describes a developing device. The developing device includes a developer carrier that transports a developer to a development area and carries the developer in the development area, a restricting member that restricts the amount of the developer on the developer carrier, a casing that is open upward to accommodate the developer, the developer carrier, and the restricting member, and a covering, which covers at least part of the developer carrier and the restricting member. The developer carrier includes a rotatable development sleeve, and a magnet roller that is disposed in the development sleeve and includes multiple magnetic poles. The portion of the covering that covers the developer carrier and the restricting member satisfies the following conditions:

a. a gap with a uniform width is formed between the covering and the developer carrier;

b. a distal end of the covering closer to the development area is disposed upstream of a transport pole of the magnetic poles, the transport pole being disposed downstream in a developer transport direction than a restricting pole opposing the restricting member; and c. an outlet through which air flows out is formed between the developer carrier and the distal end of the covering, and an air inlet is formed in the covering, to form an air flow uniformly directing from the inlet to the outlet along the restricting member and the developer carrier.

SUMMARY

Aspects of non-limiting embodiments of the present disclosure relate to a developing device that has a lower internal pressure than a structure having a gap only between a development roller and a housing.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device that includes a development roller that rotates to transfer a developer to an image carrier; a housing that includes an opening, which allows the development roller to face the image carrier therethrough, and a flow-in path, which is a gap formed to allow air to flow therethrough between the development roller and an edge of the opening downstream in a rotation direction of the development roller; a suction device that has a suction path having a distal end serving as a suction port that is open to an outside of the housing, the suction device sucking air through the suction port; and a discharging device that includes a through-hole, which extends through the housing to connect an inside to an outside of the housing, and a discharge path, which extends from the through-hole to the suction port, the discharge path merging with the suction path.

BRIEF DESCRIPTION OF THE DRAWINGS

Exemplary embodiments of the present disclosure will be described in detail based on the following figures, wherein.

DETAILED DESCRIPTION

Figure 1:
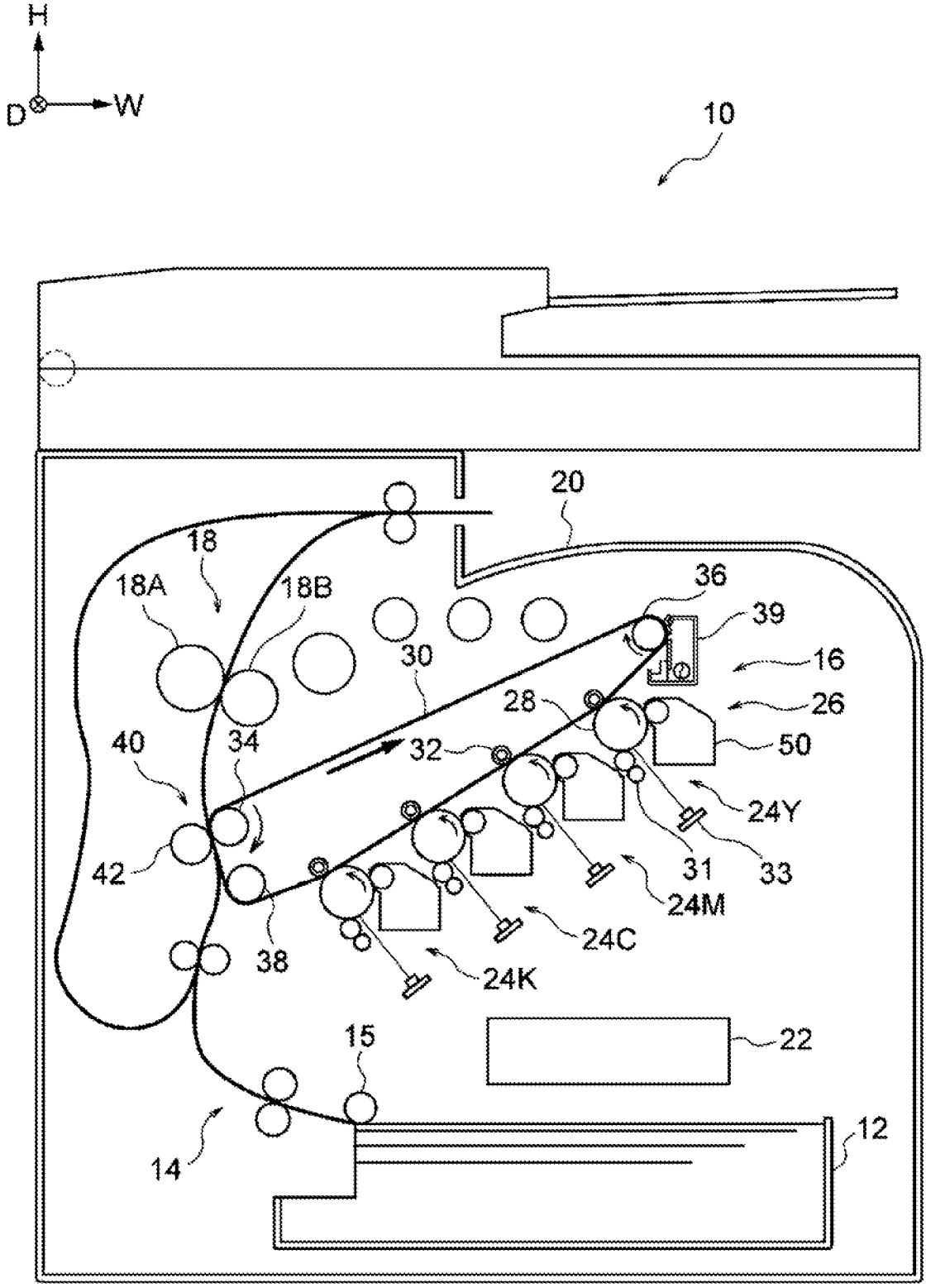
FIG. 1 is a schematic structural diagram of an example of the entire structure of an image forming apparatus according to an exemplary embodiment.

Hereinbelow, a fixing device and an image forming apparatus according to an exemplary embodiment of the present disclosure will be described below with reference to the drawings. Throughout the drawings, the direction of arrow H denotes an apparatus height direction, and the direction of arrow W denotes an apparatus width direction. Also in the drawings, the direction of arrow D, perpendicular to the apparatus height direction and the apparatus width direction denotes an apparatus depth direction (arrow D points the far side in the apparatus depth direction).

Entire Structure of Image Forming Apparatus

FIG. 1 illustrates an example of a structure of an image forming apparatus including a developing device according to an exemplary embodiment of the present disclosure. As illustrated in FIG. 1, an image forming apparatus 10 includes a sheet container unit 12, which accommodates sheets P serving as an example of a medium, a transport unit 14, a toner image forming portion 16, a fixing device 18, a discharging unit 20, and a controller 22. The toner image forming portion 16 includes four image forming units 24Y, 24M, 24C, and 24K and a transfer unit 26. Here, yellow (Y), magenta (M), cyan (C), and black (K) are examples of toner colors. The image forming units 24Y, 24M, 24C, and 24K each include at least a photoconductor 28, a charging device 31, an exposure device 33, and a developing device 50. Each of the image forming units 24Y, 24M, 24C, and 24K forms a toner image of the corresponding color of yellow (Y), magenta (M), cyan (C), or black (K) on the outer circumferential surface of the corresponding photoconductor 28.

Each photoconductor 28 has a function of holding a toner image developed by the developing device 50. The photoconductor 28 is cylindrical, has a photosensitive layer on the surface, and is driven to rotate in the arrow direction by a driving device (not illustrated). Each developing device 50 develops a latent image formed on the photoconductor 28 into a toner image. Here, the photoconductor 28 is an example of an image carrier.

The transfer unit 26 includes a transfer belt 30, first transfer rollers 32 of the corresponding colors, a driving roller 34, and a second transfer roller 42. The transfer belt 30 has its position fixed by the four first transfer rollers 32, the driving roller 34, a support roller 36, and a tension roller 38, which are in contact with the inner peripheral surface of the transfer belt 30. A cleaning device 39 is disposed on the transfer belt 30 downstream of a second transfer portion 40, at which the transfer belt 30 is in contact with the second transfer roller 42. The outer circumferential surfaces of the photoconductors 28 of the image forming units 24Y, 24M, 24C, and 24K are in contact with the outer peripheral surface of the transfer belt 30 on the lower side. Here, the second transfer portion 40 is an example of a transfer unit.

The transport unit 14 includes a pickup roller 15, which picks up sheets P from the sheet container unit 12, and multiple pairs of transport rollers, not illustrated, arranged along a transport path. Each sheet P picked up by the pickup roller 15 is transported to the second transfer portion 40, at which the driving roller 34 and the second transfer roller 42 face each other. The transport unit 14 transports the sheets P to the fixing device 18. The fixing device 18 fixes, onto the sheet P, a toner image second-transferred to the sheet P. The sheet P is then transported to the discharging unit 20 by the transport unit 14.

In the image forming apparatus 10, each exposure device 33 applies exposure light corresponding to the image data of the corresponding color to the outer circumferential surface of the corresponding photoconductor 28 charged by the charging device 31, to form a latent image corresponding to the image data of the corresponding color on the outer circumferential surface of the corresponding photoconductor 28. The latent image formed on the outer circumferential surface of the corresponding photoconductor 28 is developed by the corresponding developing device 50 into a toner image of the corresponding color. The toner image of the corresponding color on the outer circumferential surface of the corresponding photoconductor 28 is first-transferred to the outer circumferential surface of the transfer belt 30 by the first transfer roller 32 that the photoconductor 28 faces.

Each sheet P is fed from the sheet container unit 12 at the timing when the toner image of the corresponding color first-transferred to the transfer belt 30 arrives at the second transfer portion 40, and transported to the second transfer portion 40 including the second transfer roller 42. At the second transfer portion 40, the toner image of the corresponding color on the transfer belt 30 is second-transferred to the sheet P. The sheet P to which the toner image has been transferred is transported to the fixing device 18, is heated and pressed at a contact portion where a pressure roller 18A and a heat roller 18B are in contact, has the toner image sheet P fixed thereto, and is then discharged to the discharging unit 20.

Structure and Basic Operation of Developing Device

The developing devices 50 will now be described in detail. The developing devices 50 of different colors have the same structure, and thus, one of the developing devices 50 will be described as an example.

Figure 2:
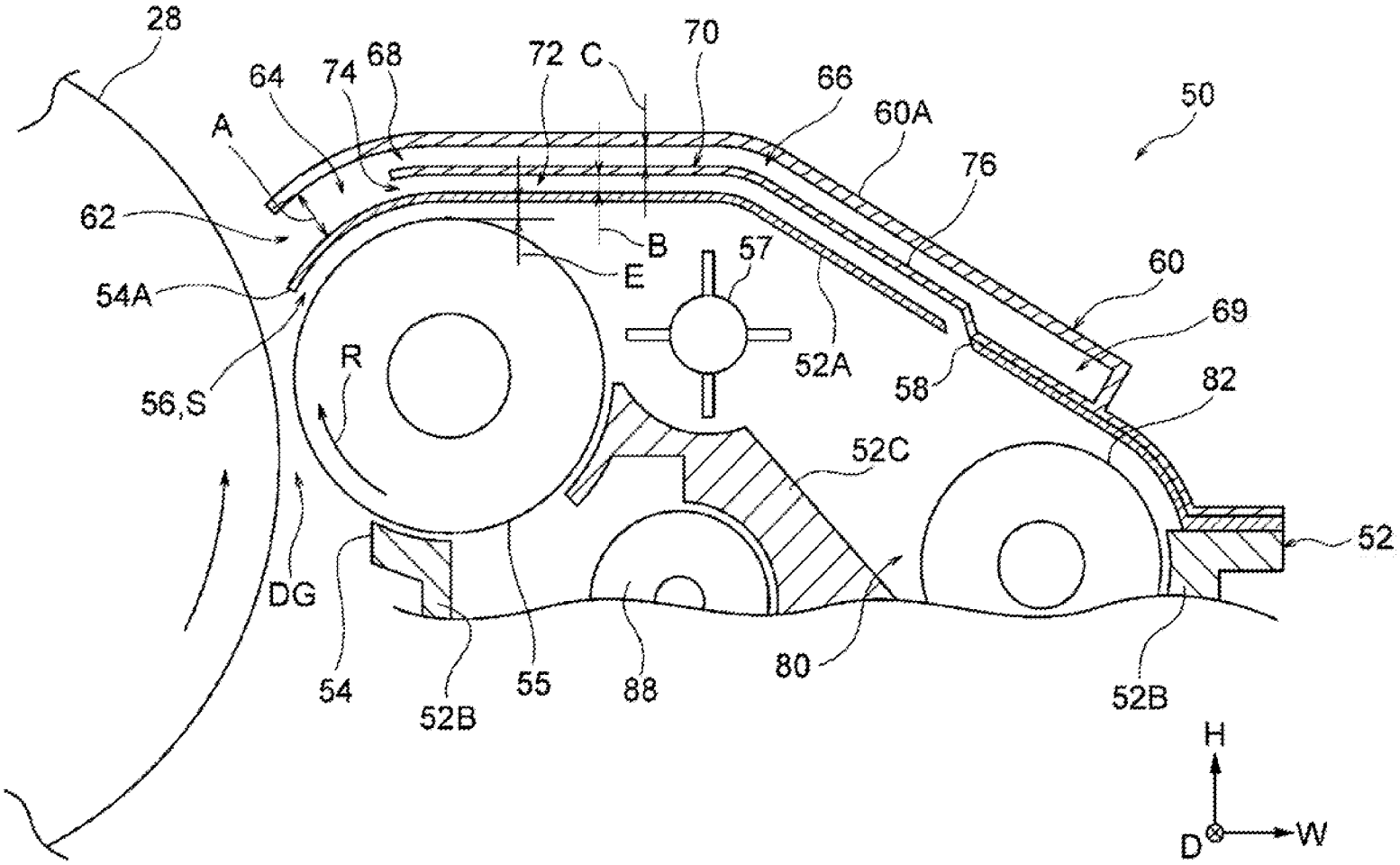
FIG. 2 is a cross-sectional view of an example of a structure of a developing device according to an exemplary embodiment.
Figure 3:
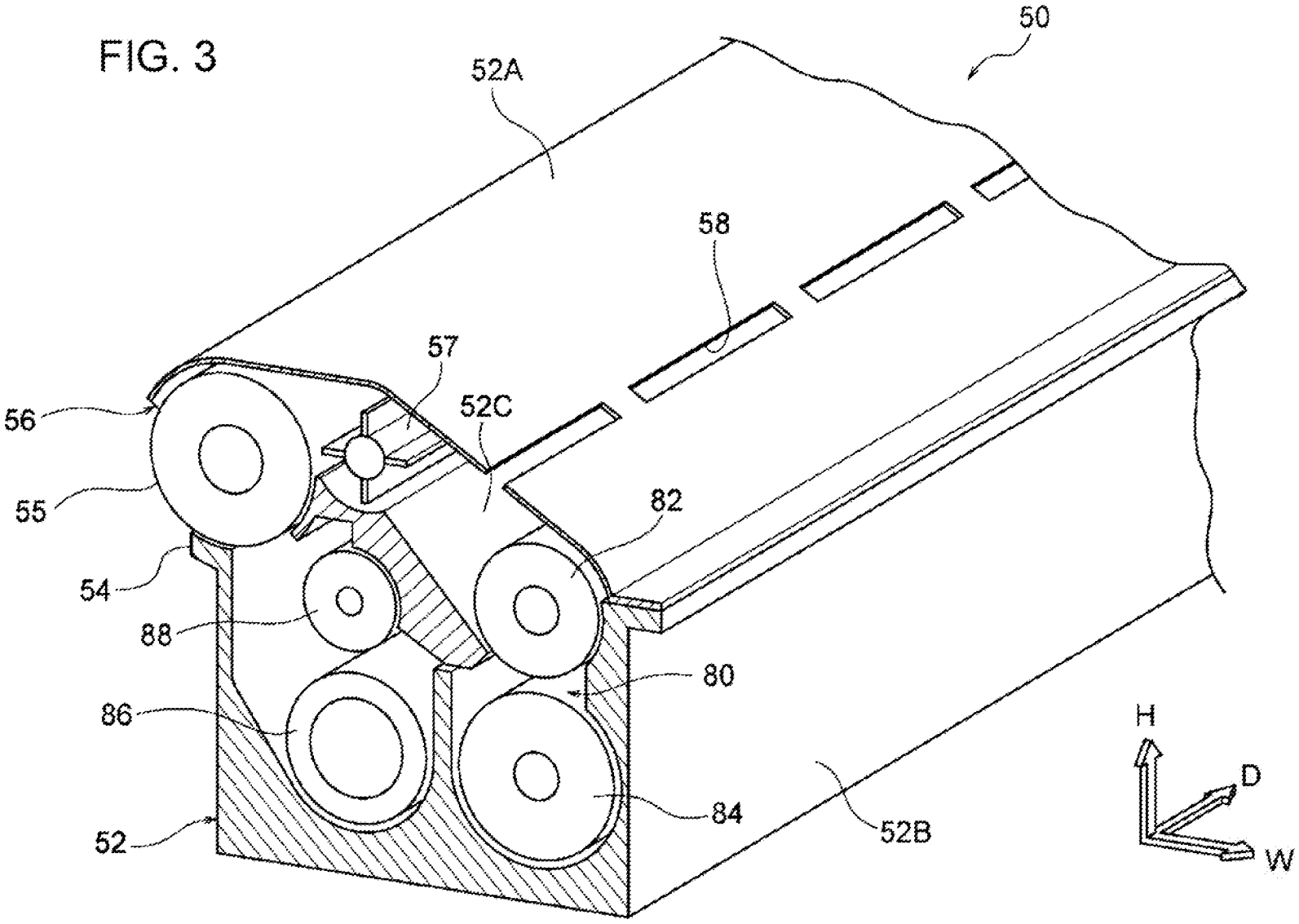
FIG. 3 is a perspective view of an example of a structure of a through-hole of a developing device according to an exemplary embodiment.

As illustrated in FIGS. 2 and 3, the developing device 50 is a device having a longitudinal direction coinciding with an apparatus depth direction D (direction from the near side to the far side in FIG. 1) of the image forming apparatus 10.

The developing device 50 includes an agitation transport path 80, which accommodates at least a developer not illustrated, a transport member 82, an agitating transport member 84, and an agitating feeding member 86. The transport member 82, the agitating transport member 84, and the agitating feeding member 86 each have a shaft and a helical blade protruding from the outer circumferential surface of the shaft.

The agitation transport path 80 has a longitudinal direction coinciding with the apparatus depth direction D.

In the present exemplary embodiment, the developer is fed through a developer feed port, not illustrated. The fed developer is transported while being agitated by the transport member 82 illustrated in FIG. 3 to be fed to the agitating transport member 84. The fed developer is then transported while being agitated by the agitating transport member 84 along the agitation transport path 80 in the longitudinal direction. The developer transported by the agitating transport member 84 is passed to the agitating feeding member 86 through connection paths, not illustrated, disposed on both sides of the agitation transport path 80 in the longitudinal direction. The developer passed to the agitating feeding member 86 is fed to a development roller 55 by a draw roller 88. The developer fed to the development roller 55 is passed to the photoconductor 28 to develop the electrostatic latent image on the photoconductor 28. The development roller 55 rotates in a direction from below to above in a development gap DG formed between itself and the photoconductor 28 (refer to arrow R in the drawing). The developer not consumed for developing the electrostatic latent image is recovered into a housing 52 via a flow-in path 56, described below, to be fed to the transport member 82.

Structure of Related Components

Figure 4:
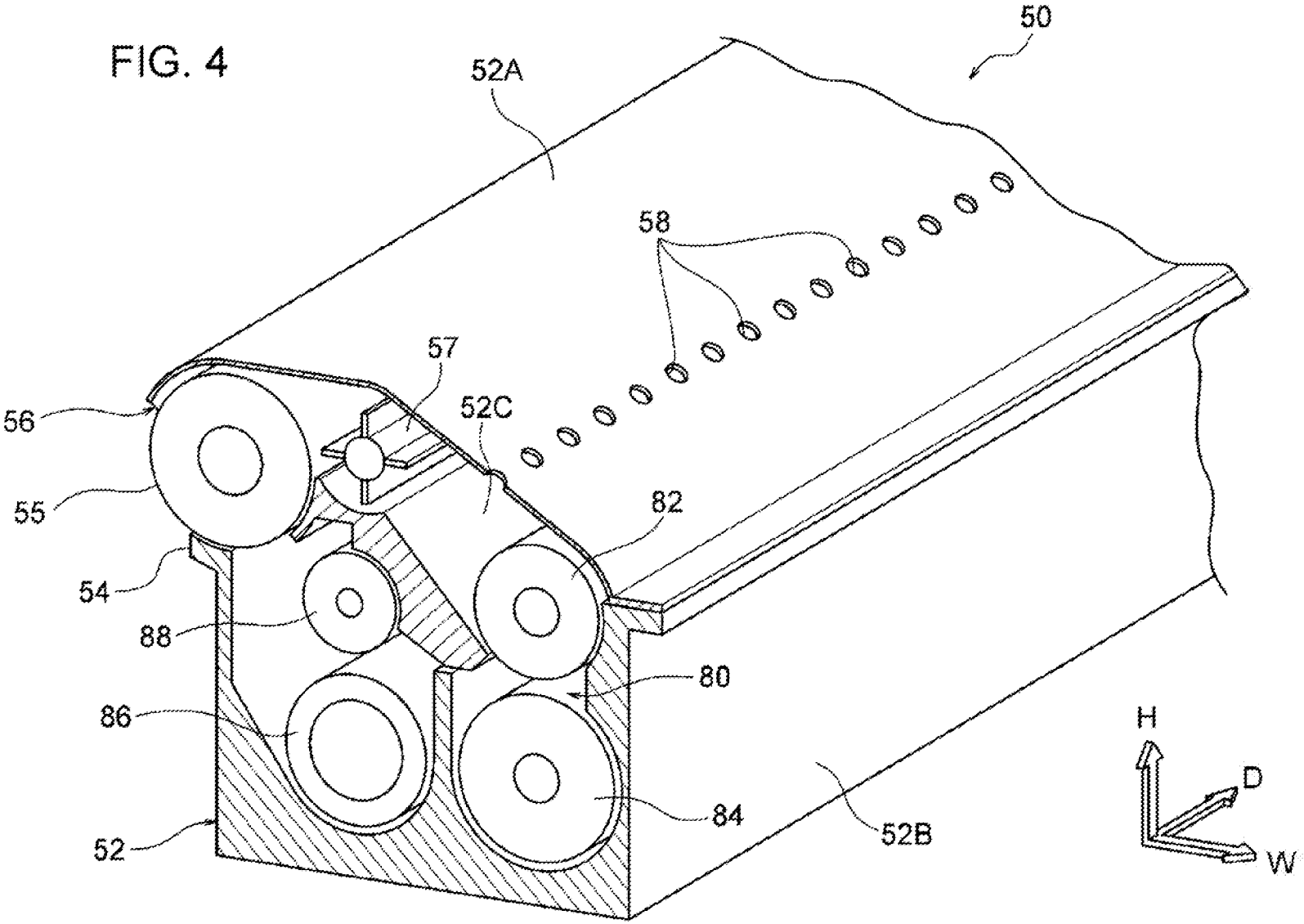
FIG. 4 is a perspective view of another example of a structure of a through-hole of a developing device according to an exemplary embodiment.

A suction device 60 and a discharging device 70 of the developing device 50, which are related components of the present disclosure, will now be described with reference to FIGS. 2 to 4.

The developing device 50 according to the present exemplary embodiment includes the housing 52, and accommodates the developer on the lower portion in the housing 52. The housing 52 accommodates the transport member 82, the agitating transport member 84, the agitating feeding member 86, the draw roller 88, and the development roller 55. The housing 52 includes an opening 54, which allows the development roller 55 to face the photoconductor 28 therethrough, and the flow-in path 56, which forms a gap S between the development roller 55 and an edge 54A of the opening 54 downstream in the rotation direction R of the development roller 55. The flow-in path 56 allows air to flow thereinto.

Specifically, the housing 52 includes a base 52B disposed below in the apparatus height direction H, and a lid 52A, which covers the base 52B from above. The lid 52A forms the opening 54 between itself and the base 52B. The opening 54 allows the development roller 55 to face the photoconductor 28 therethrough. Specifically, the distal end of the lid 52A forms the downstream edge 54A of the opening 54 in the rotation direction R of the development roller 55, that is, the upper edge 54A of the opening 54 in the apparatus height direction H. The gap S is formed between the edge 54A and the outer circumferential surface of the development roller 55. The lid 52A extends from the edge 54A to cover the development roller 55 along the outer circumferential surface of the development roller 55, and forms the flow-in path 56.

The flow-in path 56 extends from the opening 54 to a portion accommodating the transport member 82, and is separated from the portion accommodating the agitating feeding member 86 and the draw roller 88 by a partition 52C. The partition 52C extends on the side of the development roller 55 opposite to the opening 54 to form a curved surface. The partition 52C extends downhill from the end of the curved surface toward the transport member 82.

A recovery roller 57 is disposed in the flow-in path 56 on the curved surface of the partition 52C. The recovery roller 57 scoops out the developer removed from the development roller 55 toward the downhill closer to the transport member 82. Here, the recovery roller 57 is an example of a recovery device.

The developing device 50 includes the suction device 60 and the discharging device 70. The suction device 60 includes a suction path 66 having a suction port 64 having a distal end serving as a suction port 62 that is open to the outside of the housing 52. The suction device 60 sucks air through the suction port 62. The discharging device 70 includes through-holes 58, which extend through the housing to connect the inside and outside of the housing 52, and a discharge path 72, which extends from the through-holes 58 to the suction port 62. The discharge path 72 merges with the inside of the suction path 66 via the suction port 64, which is part of the suction path 66, at a portion closer to the suction port 62 than the through-holes 58. The details will be described below.

Discharging Device

As described above, the discharging device 70 includes the through-holes 58 and the discharge path 72. The through-holes 58 extend through a portion of the lid 52A forming the flow-in path 56 in the thickness direction. In the present exemplary embodiment, the through-holes 58 are formed at a portion between the recovery roller 57 and the transport member 82. The through-holes 58 are located closer to the transport member 82 than the recovery roller 57. Here, a space surrounded by the lid 52A and the base 52B is an inside of the housing 52. Outside of this space, that is, the outside of the lid 52A is the outside of the housing 52. As described above, each through-hole 58 extends through the housing 52 to connect the inside and outside of the housing 52.

The housing 52 includes a partition 76, which is spaced a gap apart from the upper surface of the lid 52A. The discharge path 72 is formed between the lid 52A and the partition 76. More specifically, the discharge path 72 is a space defined by the upper surface of the lid 52A in the apparatus height direction H, the lower surface of the partition 76 in the apparatus height direction H, and the inner surfaces of members disposed to close the gaps on both sides in the apparatus depth direction D. The discharge path 72, in other words, the partition 76 extends from near the through-holes 58 toward the development roller 55. The distal end of the partition 76 serves as a downstream end of the discharge path 72, having the through-holes 58 as an upstream end, and forms the confluence where it meets the suction path 66, as will be described below.

The discharge path 72 merges with the suction path 66 inside the suction port 64, which will be described in detail below, at a portion of the discharge path 72 closer to the suction port 62 than the through-holes 58. Specifically, a discharge opening 74 of the discharge path 72 and a suction opening 68, described below, are disposed to face the suction port 64, so that the discharge path 72 and the suction path 66 merge with each other.

Suction Device

As described below, the suction device 60 includes the suction port 62 and the suction path 66. The housing 52 includes a suction lid 60A, which is spaced a gap apart from the partition 76 and part of the lid 52A located closer to the opening 54 beyond the partition 76. The suction path 66 is formed between the suction lid 60A, the partition 76, and part of the lid 52A located closer to the opening 54 beyond the partition 76. More specifically, the suction path 66 is formed as a space defined by the suction lid 60A, the upper surfaces of the partition 76 and part of the lid 52A located closer to the opening 54 beyond the partition 76, and inner surfaces of members that close the gaps on both sides in the apparatus depth direction D.

The space between the distal end of the suction lid 60A and the edge 54A, which is the distal end of the lid 52A, serves as the suction port 62. The portion of the suction path 66 from the suction port 62 to the distal end of the partition 76 serves as the suction port 64. The suction port 64 is the confluence between the discharge path 72 and the suction path 66. From another viewpoint, a portion of the suction path 66 closer to the development roller 55 has a distal end located above the opening 54 of the housing 52, has the suction port 62 open to the outside, and has the suction port 64 extending from the suction port 62 away from the photoconductor 28. Inside the suction port 64, the suction opening 68 is open to be connected to the outside, and the suction path 66 extends from the suction opening 68 toward the agitation transport path 80.

Inside the suction port 64, the discharge opening 74 is open to be connected to the outside, and the discharge path 72 extends from the discharge opening 74 toward the agitation transport path 80. Thus, as described above, the discharge opening 74 and the suction opening 68 are arranged with the end of the partition 76 interposed therebetween to face the suction port 64. The suction port 64 (the distal end of the partition 76) serves as the confluence of the discharge path 72 to the suction path 66. In other words, the end of the partition 76 is located closer to the recovery roller 57 (further downstream in the flow-in path 56 and further upstream in the discharge path 72) than the edge 54A. The end of the suction lid 60A is located closer to the edge 54A than the end of the partition 76. The suction port 64 is located between the lid 52A and the suction lid 60A closer to the edge 54A than the partition 76.

The end portion of the suction path 66 closer to the agitation transport path 80 extends to cover the entirety of the partition 76 beyond the through-holes 58, and reaches a flow path 69 extending in the apparatus depth direction D. A suction side of a suction member such as a fan, not illustrated, is connected to the end portion of the flow path 69, to form a structure that sucks air from the suction opening 68 through the suction path 66. A filter is removably attached to the end portion of the flow path 69.

Operations and Effects of Related Portions

The developing device 50 has the above-described components. The operations and effects of the developing device 50 having these components will be described with reference to FIGS. 2 to 4.

The developing device 50 transports the developer while agitating it to pass it to the development roller 55. Here, toner cloud occurs in the developing device 50, in the process of passing the developer from the agitating feeding member 86 to the development roller 55, and then to the photoconductor 28.

First, a developing device according to a first comparative example has a structure including a gap only between the development roller and the housing. In this structure, an air flow caused in association with rotation of the development roller 55 in the direction of arrow R flows into the housing through the gap, and raises the pressure inside the housing while retaining the pressure inside the developing device without decreasing. In this state, the amount of toner cloud that flows into the housing through the gap decreases.

A developing device according to a second comparative example has a structure including a housing that has a through-hole and a filter. At the beginning of the development, the internal pressure of the housing degreases, but clogging of the filter reduces the toner-cloud recovery efficiency. This state disables removal of the toner cloud.

In the developing device according to the present exemplary embodiment, on the other hand, the toner cloud wafting around the flow-in path 56 and the suction port 62 is drawn by an air flow accompanied by rotation of the development roller 55 in the direction of arrow R to flow into the flow-in path 56 through the gap S. The toner cloud that has flowed into the flow-in path 56 is recovered by the rotation of the recovery roller 57 toward the agitation transport path 80 located opposite to the development roller 55.

On the other hand, the suction device 60 sucks air from the suction port 62. Thus, the toner cloud that has leaked out of the developing device 50 accompanied by rotation of the photoconductor 28 without flowing into the flow-in path 56 is sucked from the suction port 62 into the suction port 64, which is part of the suction path 66. The toner cloud discharged from the discharge opening 74 is merged with the toner cloud sucked from the suction port 62 through the suction port 64, and sucked into the suction path 66 through the suction opening 68. This structure reduces the internal pressure of the developing device 50 compared to the structure having a gap S only between the development roller 55 and the housing 52.

Here, air inside the developing device 50 is discharged to the discharge path 72 from the through-holes 58 located closer to the agitation transport path 80. Thus, the developing device 50 according to the present exemplary embodiment reduces the internal pressure of the housing 52 and prevents reduction of the amount of toner cloud flowing into the housing 52 through the gap S compared to the developing device according to the first comparative example. In the developing device 50, air inside the housing 52 is discharged through the suction device 60. Thus, the developing device 50 according to the present exemplary embodiment prevents clogging of a filter compared to the developing device according to the second comparative example, and retains an effect of removing the toner cloud. The discharge path 72 extends from the through-holes 58 to the position close to the suction port 62 of the suction path 66. Air at the discharge opening 74, which is part of a suction path and located in the suction port 64, is sucked at the suction opening 68 of the suction path 66. Thus, in the discharge path 72, a pressure loss occurs due to the length of the flow path from the through-holes 58 to the discharge opening 74, and the pressure inside the discharge path 72 gradually decreases toward the discharge opening 74 from the through-holes 58. Thus, the developing device 50 according to the present exemplary embodiment prevents suction of toner inside the housing 52, so that the life of the filter is secured.

As described above, the present exemplary embodiment includes the housing 52. The housing 52 includes the development roller 55, which rotates to pass the developer to the photoconductor 28, the opening 54, which allows the development roller 55 to face the photoconductor 28 therethrough, and the flow-in path 56 having a gap S between the development roller 55 and the downstream edge 54A of the opening 54 in the rotation direction of the development roller 55 to allow air to flow therethrough. The present exemplary embodiment also includes the suction device 60, which sucks air from the suction port 62 and includes the suction path 66 having a distal end serving as the suction port 62 that is open to the outside of the housing 52, the through-holes 58, which extends through the housing to connect the inside and the outside of the housing 52, and the discharge path 72, which extends from the through-holes 58 to the suction port 62. The discharge path 72 includes the discharging device 70, which merges with the suction path 66.

Thus, the developing device 50 has a lower internal pressure than a structure including a gap S only between the development roller 55 and the housing 52.

The discharge path 72 merges with the inside of the suction path 66 at a portion closer to the suction port 62 than the through-holes 58.

This structure thus prevents suction of toner in the housing 52 compared to the structure where the discharge path 72 merges with the inside of the suction path 66 at a portion closer to the through-holes 58 than the suction port 62.

The height A of the suction port 62 is larger than or equal to the sum of a height B of the discharge path 72 and a height C of the suction path 66. In other words, the suction port 62 is higher than the portion formed with the discharge path 72 and the suction path 66.

Thus, the internal pressure of the developing device 50 is reduced further than the structure where the suction port 62 has the height A smaller than the sum of the height B of the discharge path 72 and the height C of the suction path 66.

The suction path 66 and the discharge path 72 are located adjacent to each other. In other words, the suction path 66 and the discharge path 72 share the partition 76.

Thus, the developing device 50 is smaller than a structure where the suction path 66 and the discharge path 72 are spaced apart from each other.

The flow-in path 56, the discharge path 72, and the suction path 66 are arranged adjacent to each other in this order toward the outside of the housing 52. In other words, the lid 52A, the partition 76, and the suction lid 60A are arranged adjacent to each other in this order toward the outside of the housing 52.

Thus, the developing device 50 is smaller than the structure where the flow-in path 56, the suction path 66, and the discharge path 72 are arranged adjacent to each other in this order.

The through-holes 58 are disposed between the recovery roller 57, which recovers toner on the side opposite to the opening 54 of the development roller 55, and the agitation transport path 80, which is disposed opposite to the opening 54 of the recovery roller 57. Specifically, the through-holes 58 are formed in the lid 52A between the agitation transport path 80 and the recovery roller 57 located closer to the development roller 55.

This structure reduces the internal pressure of the developing device compared to a structure where the through-holes 58 are formed at a position different from the position between the agitation transport path 80, disposed on the side of the opening 54 opposite to the photoconductor 28, and the recovery roller 57, located opposite to the opening 54 of the development roller 55 to recover toner.

The agitation transport path 80 includes the transport member 82, which transports a developer. The through-holes 58 are arranged closer to the transport member 82 than the recovery roller 57. Specifically, the through-holes 58 are formed in the lid 52A at a position close to the transport member 82 of the agitation transport path 80, or more specifically, within an area over the transport member 82.

This structure improves recovery efficiency of toner cloud compared to the structure where the through-holes 58 are arranged closer to the recovery roller 57 than the transport member 82.

The height B of the discharge path 72 is larger than the height C of the suction path 66. In other words, the height of the discharge opening 74 is larger than the height of the suction opening 68.

This structure prevents clogging in the discharge path 72 compared to the structure where the height of the discharge path 72 is smaller than the height of the suction path 66.

The height C of the suction path 66 is larger than the height E of the flow-in path 56. In other words, the height of the suction opening 68 is larger than the distance of the gap S.

This structure thus prevents clogging of toner in the flow-in path 56 compared to the structure where the height of the suction path 66 is smaller than the height of the flow-in path 56.

The image forming apparatus 10 according to the present exemplary embodiment includes the photoconductor 28, the developing device 50 of any one of the exemplary embodiments, and the second transfer portion 40, at which developer images are transferred from the photoconductors 28 to each sheet P.

Thus, image defects in the image forming apparatus 10 are prevented.

The exemplary embodiments of the present disclosure have been described above using one exemplary embodiment. However, these exemplary embodiments are mere examples, and may naturally be changed in various manners within the scope not departing from the gist of the present disclosure without restricting the scope of the present disclosure to these exemplary embodiments.

For example, in the above description, the suction path 66 and the discharge path 72 are disposed adjacent to the flow-in path 56 in the housing 52, but may be spaced apart from the flow-in path 56. In this case, the discharge path 72 may be formed with a member different from the lid 52A, instead of being formed between the partition 76 and the lid 52A.

In the above description, the discharge opening 74 is open to the suction port 64, which is part of the suction path 66. Instead, the side of the discharge opening 74 facing the suction port 64 between the lid 52A and the partition 76 may be closed, and the discharge opening 74 may extend through the partition 76 toward the suction path 66.

In the above description, the suction path 66 and the discharge path 72 are separate from the lid 52A of the housing 52. Instead, the suction path 66 and the discharge path 72 may be integrated with the lid 52A.

In the above description, the developing device 50 includes the recovery roller 57 downstream in the rotation direction R of the development roller 55. Instead, the developing device 50 may exclude the recovery roller 57.

In the above description, the developing device 50 includes the partition 52C, which separates the draw roller 88 from the transport member 82 and the agitating transport member 84. Instead, the developing device 50 may exclude the partition 52C, the draw roller 88, and the transport member 82.

In the above description, the developing device 50 has the discharge path 72 that merges with the suction path 66 at a position closer to the suction port 62 than the through-holes 58. Instead, the discharge path 72 may merge with the suction path 66 at a position closer to the through-holes 58 than the suction port 62.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device, comprising:

a development roller that rotates to pass a developer to an image carrier;

a housing that includes an opening, which allows the development roller to face the image carrier therethrough, and a flow-in path, which is a gap formed to allow air to flow therethrough between the development roller and an edge of the opening downstream in a rotation direction of the development roller;

a suction device that has a suction path having a distal end serving as a suction port that is open to an outside of the housing, the suction device sucking air through the suction port; and a discharging device that includes a through-hole, which extends through the housing to connect an inside to an outside of the housing, and a discharge path, which extends from the through-hole to the suction port, the discharge path merging with the suction path.

2. The developing device according to claim 1, wherein the discharge path merges with the suction path inside the suction path at a portion closer to the suction port than the through-hole.

3. The developing device according to claim 2, wherein the suction port has a height larger than or equal to a sum of a height of the discharge path and a height of the suction path.

4. The developing device according to claim 3, wherein the suction path and the discharge path are arranged adjacent to each other.

5. The developing device according to claim 4, wherein the flow-in path, the discharge path, and the suction path are arranged adjacent to each other in order of the flow-in path, the discharge path, and the suction path toward an outside of the housing.

6. The developing device according to claim 3, wherein the through-hole is disposed between a recovery device, which is disposed on a side of the development roller opposite to the opening to recover toner, and an agitation transport path, which is disposed on a side of the recovery device opposite to the opening.

7. The developing device according to claim 2,
wherein the suction path and the discharge path are arranged adjacent to each other.

8. The developing device according to claim 7,
wherein the flow-in path, the discharge path, and the suction path are arranged adjacent to each other in order of the flow-in path, the discharge path, and the suction path toward an outside of the housing.

9. The developing device according to claim 2,
wherein the through-hole is disposed between a recovery device, which is disposed on a side of the development roller opposite to the opening to recover toner, and an agitation transport path, which is disposed on a side of the recovery device opposite to the opening.

10. The developing device according to claim 1,
wherein the suction port has a height larger than or equal to a sum of a height of the discharge path and a height of the suction path.

11. The developing device according to claim 10,
wherein the suction path and the discharge path are arranged adjacent to each other.

12. The developing device according to claim 11,
wherein the flow-in path, the discharge path, and the suction path are arranged adjacent to each other in order of the flow-in path, the discharge path, and the suction path toward an outside of the housing.

13. The developing device according to claim 10,
wherein the through-hole is disposed between a recovery device, which is disposed on a side of the development roller opposite to the opening to recover toner, and an agitation transport path, which is disposed on a side of the recovery device opposite to the opening.

14. The developing device according to claim 1,
wherein the suction path and the discharge path are arranged adjacent to each other.

15. The developing device according to claim 14,
wherein the flow-in path, the discharge path, and the suction path are arranged adjacent to each other in order of the flow-in path, the discharge path, and the suction path toward an outside of the housing.

16. The developing device according to claim 1,
wherein the through-hole is disposed between a recovery device, which is disposed on a side of the development roller opposite to the opening to recover toner, and an agitation transport path, which is disposed on a side of the recovery device opposite to the opening.

17. The developing device according to claim 16,
wherein the agitation transport path includes a transport member, which transports a developer while agitating the developer, and the through-hole is disposed closer to the transport member than the recovery device.

18. The developing device according to claim 1,
wherein the discharge path has a height larger than a height of the suction path.

19. The developing device according to claim 1,
wherein the suction path has a height larger than a height of the flow-in path.

20. An image forming apparatus, comprising:
an image carrier;
the developing device according to claim 1; and
a transfer unit which transfers a developer image from the image carrier to a medium.

* * * * *